United States Patent [19]

Hasegawa

[11] 4,385,944

[45] May 31, 1983

[54] MAGNETIC IMPLEMENTS FROM GLASSY ALLOYS

[75] Inventor: Ryusuke Hasegawa, Morristown, N.J.

[73] Assignee: Allied Corporation, Morristown, N.J.

[21] Appl. No.: 154,187

[22] Filed: May 29, 1980

[51] Int. Cl.[3] ..... H01F 1/02

[52] U.S. Cl. ..... 148/104; 148/31.55; 75/230; 419/11; 419/33; 419/35; 419/60; 419/68

[58] Field of Search ..... 148/31.55, 31.57, 101, 148/102, 103, 104, 105, 108; 75/200, 201, 212, 223, 226, 228, 230; 264/111

[56] References Cited

U.S. PATENT DOCUMENTS

| | | | |
|---|---|---|---|
| 3,725,091 | 4/1973 | Chyung et al. | 75/201 |
| 3,856,513 | 12/1974 | Chen et al. | 75/122 |
| 4,036,638 | 7/1977 | Ray et al. | 75/123 B |
| 4,063,942 | 12/1977 | Lundgren | 75/251 |
| 4,069,045 | 1/1978 | Lundgren | 75/251 |
| 4,104,787 | 8/1978 | Jandeska et al. | 75/200 |
| 4,197,146 | 4/1980 | Frischman | 148/104 |
| 4,221,587 | 9/1980 | Ray | 75/0.5 C |

OTHER PUBLICATIONS

Bozorth, R. M., Ferromagnetism, D. Van Nostrand, 1951, pp. 6 & 7.

A Dictionary of Metallurgy, A. D. Merriman, Mac Donald and Evans Ltd., London, 1958, pp. 256–257.

Fundamental Principles of Powder Metallurgy, W. D. Jones, Edward Arnold, (Pub.), London, pp. 382–383.

Applied Physics Letters, 33(5), Sep. 1, 1978, pp. 468–470, Yamaguchi et al.

Introduction to Powder Metallurgy, J. S. Hirschhorn, American Powder Metallurgy Inst., 1969, pp. 96–98.

*Primary Examiner*—John P. Sheehan

*Attorney, Agent, or Firm*—Ernest D. Buff; Gerhard H. Fuchs

[57] ABSTRACT

A method for making magnetic crystallized implements based on glassy metal alloys. Metallic glass alloy powder of suitable ferromagnetic composition is compacted by mechanical, by adhesive bonding or by thermomechanical processes. The resulting compacts can be heat treated to enhance magnetic properties. Compacted bodies exhibit excellent ferromagnetic properties, low remanence, low coercivity and high permeabilities.

5 Claims, No Drawings

MAGNETIC IMPLEMENTS FROM GLASSY ALLOYS

BACKGROUND OF THE INVENTION

1. Field of the Invention

The invention relates to magnetic articles made as cores and pole pieces and to a process for making them from metallic glass powder.

2. Description of the Prior Art

Amorphous metal alloys and articles made therefrom are disclosed by Chen and Polk in U.S. Pat. No. 3,856,513 issued Dec. 24, 1974. This patent teaches certain novel metal alloy compositions which are obtained in the amorphous state and are superior to such previously known crystalline alloys based on the same metals. These compositions are easily quenched to the amorphous state and possess desirable physical properties. This patent discloses that powders of such amorphous metals with particle size ranging from about 10 to 250 μm can be made by atomizing the molten alloy to form droplets thereof and quenching the droplets in a liquid such as water, refrigerated brine or liquid nitrogen.

Manufacture of magnetic articles by consolidation of permalloy and other crystalline alloy powders is known. New applications requiring improved magnetic properties have necessitated efforts to develop alloys and consolidation processes that increase, concomitantly, the strength and magnetic response of magnetic articles.

SUMMARY OF THE INVENTION

The present invention provides amorphous metal alloy powders especially suited for consolidation into bodies having excellent strength and magnetic response. In addition, the invention provides a method for manufacture of magnetic articles in which consolidation of glassy metal powder is effected using mechanical pressure and/or a binder.

Articles produced in accordance with the method of this invention have low remanence and high permeability. Typically, such consolidated megnetic glassy metal alloy bodies have an initial relative magnetic permeability of at least about 100. As used herein, the term "relative permeability" is intended to mean the ratio of the magnetic induction in a medium generated by a certain field to the magnetic induction in vacuum generated by the same field.

DETAILED DESCRIPTION OF THE INVENTION

The magnetic compact bodies with high permeability of the present invention are generally made from glassy metal alloys in powder form. The general process for preparing metallic glass powders from alloys involves a step of rapid quenching and a step of atomization. Either step can come first and the process can be performed in either sequence. Methods for the preparation of glassy metal alloy powders are disclosed inthe copending applications Ser. Nos. 23,411 now U.S. Pat. No. 4,290,808, 23,412 now U.S. Pat. No. 4,221,587; and 23,413, each of which was filed Mar. 23, 1979. The preparation of a glassy alloy can be achieved by following the teaching set forth in U.S. Pat. No. 3,856,553 to Chen, et al. The resulting sheets, ribbons, tapes and wires ae useful precursors of the materials disclosed here.

Starting with the powder consolidation of the powder is the initial step in producing a body. Powder adjusted for consolidation can comprise fine powder (having particle size under 100 micrometers), coarse powder (having particle size between 100 micrometers and 1000 micrometers) and flake (having particle size between 1000 micrometers and about 5000 micrometers). Consolidation can be obtained by pressing or adhesively bonding glassy metal alloy powder.

In case low permeabilities are desired a particle diameter of about 5–10 micrometers is used. For high permeabilities, larger particle diameters of about 0.1 mm or more are employed. A combination of relatively high permeability (e.g., in the order of about 100) and excellent mechanical hardness (e.g., in the order of about 800 $kg/mm^2$) is achieved by use of particles having a mesh size (U.S. Sieve) of about 325. Flake cores employ larger particles having parallel planes. The properties in this case come closer to those of lamellar cores.

For consolidation, powders can be put in evacuated cans and then be formed to strips or isostatically pressed to discs, rings or any other desirable shape. Furthermore, powders can be vacuum hot pressed below their glass transition temperature by conventional techniques into any desirable shape. Preferably, the finest powder is cold pressed.

The powders can be mixed with a suitable organic binder, for instance, paraffin, etc., and then cold pressed to suitable forms. As insulator and binder there are employed resins such as phenolic formaldehyde resins, e.g., bakelite (trademark Union Carbide Corp.). Other suitable binders include synthetic resins, drying oils, residues from distillation of oils or fats, solutions of gums or resins, and oxidized oil or wax compounds. The amount of binder can be up to 30 weight percent and is preferably less than 10 weight percent and more preferably between 0.5 and 3 weight percent for high permeability cores. Such formed alloy can have a density of at least 60 percent of the theoretical maximum. The pressed object can be cured at a relatively low temperature below the glass transistion temperature to give more strength and then ground to final dimensions. The preferred product of this process comprises shapes suitable as magnetic components.

The curing process can be performed with simultaneous application of a magnetic field. Preferably, the curing process is performed in the absence of oxygen. The processes are adapted to the optimum heat treatment cycles so as to yield a desirable magnetic and structural product made from glassy metal alloy.

After the compaction, the final product is ground to final dimensions. This process is suitable to fabricate large engineering tools of simple geometry. Furthermore, the finished product can be annealed as desired, depending on the particular alloy used in the application at hand. The solid body has a density of not less than about 60 percent and preferably 95 percent of the alloy in a cast state.

A metallic glass is an alloy product of fusion which has been cooled to a rigid condition without crystallization. Such metallic glasses generally have at least some of the following properties: high hardness and resistance to scratching, great smoothness of a glassy surface, dimensional and shape stability, mechanical stiffness, strength, ductility, high electrical resistance compared with related metals and alloys thereof, and a diffuse X-ray diffraction pattern.

The term "alloy" is used herein in the conventional sense as denoting a solid mixture of two or more metals (Condensed Chemical Dictionary, Ninth Edition, Van Norstrand Reinhold Co., New York, 1977). These alloys additionally contain admixed at least one non-metallic element. The terms "glassy metal alloy," "metallic glass," "amorphous metal alloy" and "vitreous metal alloy" are all considered equivalent as employed herein.

Alloys suitable for the processes disclosed in the present invention include the composition $[Fe,Ni,Co]_{65-88}[Mo,Nb,Ta,Cr,V]_{0-10}[P,B,C,S]_{12\propto 25}$.

Preferred ferromagnetic alloys according to the present invention are based on one member of the group consisting of iron, cobalt and nickel. The iron based alloys have the general composition $Fe_{40-88}(Co,Ni)_{0-40}(Mo,Nb,Ta,V,Cr)_{0-10}(P,B,C,Si)_{12-25}$; the cobalt based alloys have the general composition $Co_{40-88}(Fe,Ni)_{0-40}(Mo,Nb,Ta,V,Mn,Cr)_{0-10}(P,B,C,Si)_{12-25}$ and the nickel based alloys have the general composition $Ni_{40-84}(Co,Fe)_{4-40}(Mo,Nb,Ta,V,Mn,Cr)_{0-10}(P,B,C,Si)_{12-25}$.

Preferred alloys have atomic percentages of less than 5 atomic percent carbon, 20 atomic percent boron, 20 atomic percent silicon and 10 atomic percent phosphorous.

Amorphous metallic powders can be compacted to fabricate parts suitable for a variety of applications such as electromagnetic cores, pole pieces and the like. The glassy metal compacts have high permeability. They can contain much less nickel than conventional pressed alloy bodies of comparable permeability. The processing of such glassy metal powder for magnetic bodies is substantially the same as that of permalloy powders. The resulting cores can be used as transformer cores and in other alternating current applications.

For these particular applications, i.e., use of compacted amorphous metallic powders, ferromagnetic amorphous alloys should have relatively low mechanical hardness (i.e., less than 1000 kg/mm$^2$) so that compacting can be performed effectively. Amorphous alloys that are preferred for such applications include $Fe_{82}P_{18}$, $Fe_{80}P_{15}C_5$, $Fe_{88}B_{12}$, $Fe_{83}B_{17}$, $Fe_{80}P_{16}C_3B_1$, $Fe_{80}P_{14}B_6$ and $Fe_{40}Ni_{40}P_{14}B_6$. These alloys have hardness values ranging between 760 and 1000 kg/mm$^2$.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

Amorphous metallic flakes or coarse powders with sizes ranging between about 100 and 500 micrometers and 500 to 2000 micrometers of an alloy with the composition of $Fe_{40}Ni_{40}P_{14}B_6$ were prepared by quenching a stream of atomized molten droplets on a chilled substrate surface. The resulting coarse powders and flakes were subsequently embrittled by annealing below the glass transition temperature for a time of 1 hour at 200° C. and then the powders and flakes were subjected to dry ball milling under a high purity argon atmosphere for 16 hours. This process resulted in fine amorphous particles of irregular shape with particle size of less than 30 micrometers. The resulting fine powders were blended uniformly with 2 percent submicron magnesium oxide particles and the composite was pressed into ring diameter of 1.252 cm by employing high pressures between 14,000 to 17,500 kg per square centimeter. The addition of fine ceramic powder was intended to provide uniformly distributed air gap in the core to increase its resistivity. The compressed cores were annealed at 300° C. for 2 to 16 hours. Typically, a core pressed at 17,500 kilograms per square centimeter and annealed at 300° C. for 16 hours was found to possess a permeability of 125 units.

EXAMPLE 2

Three toroids were prepared from glassy metal alloy of composition $Fe_{40}Ni_{40}P_{14}B_6$. The toroids were prepared by pressing glassy metal alloy powder in a form. Sample (a) was made from comminuted glassy metal alloy and samples (b) and (c) were prepared from 325 mesh powder. Sample (a) showed a coercive field $H_c=0.69$ Oe and an initial relative permeability $\mu_o=107$. Samples (b) and (c) had coercive field $H_c$ of 2.15 Oersted and 2.58 Oersted, respectively, and an initial relative permeability of 97 and 121, respectively. Each of the toroids exhibited field-independent ac permeability of about 90 up to the frequency of 500 kHz.

Having thus described the invention in rather full detail it will be understood that these details need not be strictly adhered to but that various changes and modifications may suggest themselves to one skilled in the art, all falling within the scope of the invention as defined by the subjoined claims.

I claim:

1. A method for making molded magnetic metal alloy articles, comprising:

(a) admixing an insulator with ferromagnetic glassy metal powder;

(b) compacting said powder with mechanical pressure to form a consolidated magnetic glassy metal body, the powder particles being kept substantially separate by said insulator.

2. The method as set forth in claim 1 wherein the powder has a composition of the formula $[Fe,Ni,Co]_{88-65}[Mo,Nb,Ta,Cr,V]_{0-10}[P,B,C,Si]_{12-25}$.

3. The method according to claim 1 wherein the glassy metal powder is compacted into a form having a density of at least about 60 percent of theoretical maximum.

4. The method according to claim 1 wherein the glassy metal powder is compacted by cold pressing.

5. The method according to claim 4 wherein the cold pressing is performed isostatically with isotropic pressure applied to the article from all sides.

* * * * *